US007036193B1

(12) United States Patent
Liu

(10) Patent No.: US 7,036,193 B1
(45) Date of Patent: May 2, 2006

(54) SHOE TIGHTENING DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 11/078,734

(22) Filed: Mar. 14, 2005

(51) Int. Cl.
*A43C 7/08* (2006.01)

(52) U.S. Cl. ..... 24/712; 24/712.1; 36/50.1

(58) Field of Classification Search ..... 24/713.1, 24/712, 712.1, 712.2, 712.5, 298, 685 K, 24/DIG. 33; 36/50.1
See application file for complete search history.

(56) References Cited

U.S. PATENT DOCUMENTS 780,020 A * 1/1905 Brent ..... 36/50.1
2,289,225 A * 7/1942 Tonai ..... 24/300
2,994,935 A * 8/1961 Buchholz ..... 24/68 SK
3,808,645 A * 5/1974 Chow ..... 24/71 SK
4,157,622 A * 6/1979 Carlyle ..... 36/50.1
6,796,009 B1 * 9/2004 Liu ..... 24/712.6
6,839,944 B1 * 1/2005 Liu ..... 24/712.1
6,938,307 B1 * 9/2005 Liu ..... 24/712.5

* cited by examiner

*Primary Examiner*—Robert J. Sandy
*Assistant Examiner*—Marcus Menezes
(74) *Attorney, Agent, or Firm*—Foley & Lardner LLP

(57) ABSTRACT

A shoe tightening device is provided for use with a shoe that includes a pair of eyelet tabs each having eyelets. The shoe tightening device includes a pair of lace units, a clamp unit, and a pull lace. Each of the lace units includes connecting end portions, operating end portions, intermediate portions, and anchoring elements adapted to be anchored removably on the eyelet tabs at corresponding ones of the eyelets. The clamp unit removably clamps at least one of the lace units, and includes at least one flexible string section, and at least one clamp member. The clamp member is slidable along the flexible string section between a clamping position and a releasing position. The pull lace is connected to the flexible string section for pulling the flexible string section so that the clamp member can slide along the flexible string section to the releasing position.

12 Claims, 8 Drawing Sheets

SHOE TIGHTENING DEVICE

BACKGROUND OF THE INVENTION

1. Field of the Invention

The invention relates to a shoe tightening device, more particularly to a shoe tightening device that can be mounted on and removed from a shoe easily, and that can tighten and loosen the shoe easily and quickly.

2. Description of the Related Art

A shoe usually includes a pair of eyelet tabs and a shoelace. Each of the eyelet tabs is formed with a plurality of eyelets. The shoelace is typically strung through the eyelets to form a criss-cross pattern on the eyelet tabs, and is then tied into a knot so as to tighten the shoe. However, it is time-wasting to tie and untie the shoelace when wearing and removing the shoe.

In order to solve the aforesaid disadvantage encountered in the conventional shoe, U.S. Pat. No. 6,568,048 proposes a shoe with a shoelace device that can be tightened to simulate a double-bow knot. The shoelace device includes a shoelace, a clamp member, and a decorative knot. The shoelace has a first lace segment strung on a shoe body to form a criss-cross pattern on eyelet tabs of the shoe body, and a second lace segment forming two loops on the clamp member. In the preferred embodiment shown in FIG. 11 of this patent, the shoelace device further includes a pair of hook members for securing removably lower ends of lace sections of the second lace segment at eyelets of the eyelet tabs of the shoe body. Although the shoelace device disclosed in this patent permits the shoe to be worn and removed with relative ease, the shoelace should be strung on the shoe body to form a criss-cross pattern on the eyelet tabs. Furthermore, the clamp member has a relatively large size.

In co-pending U.S. patent application Ser. No. 10/761,229, there is disclosed a shoe tightening device for a shoe. A shoelace is required to cooperate with the shoe tightening device to tighten or loosen the shoe. Similarly, a part of the shoelace is required to be strung on eyelet tabs of the shoe.

SUMMARY OF THE INVENTION

Therefore, the object of the present invention is to provide a shoe tightening device for a shoe that can be mounted on and removed from a shoe easily, and that can tighten and loosen the shoe easily and quickly.

According to this invention, there is provided a shoe tightening device for use with a shoe that includes a pair of eyelet tabs each having a plurality of eyelets. The shoe tightening device includes a pair of lace units, a clamp unit, and a pull lace.

Each of the lace units includes a plurality of connecting end portions, a plurality of operating end portions opposite to the connecting end portions, a plurality of intermediate portions interconnecting the connecting end portions and the operating end portions correspondingly, and a plurality of anchoring elements mounted on the connecting end portions correspondingly and adapted to be anchored removably on the eyelet tabs at corresponding ones of the eyelets. The intermediate portions of at least one of the lace units have entry parts proximate to the connecting end portions and exit parts proximate to the operating end portions.

The clamp unit removably clamps at least one of the lace units, and includes at least one generally U-shaped flexible string section defining an opening, and at least one clamp member attached slidably to and extending across the flexible string section to divide the opening into a first aperture and a second aperture. The flexible string section has a U-bend which cooperates with the clamp member to confine the second aperture. The first aperture receives the entry parts of the intermediate portions of a corresponding one of the lace units. The second aperture receives the exit parts of the intermediate portions of the corresponding one of the lace units. The clamp member is slidable along the flexible string section between a clamping position in which the clamp member moves toward the U-bend to clamp the exit parts of the intermediate portions of the corresponding one of the lace units against the U-bend for maintaining a tightened state of the shoe, and a releasing position in which the clamp member moves away from the U-bend to permit sliding movement of the intermediate portions of the corresponding one of the lace units for loosening the shoe accordingly.

The pull lace is connected to the flexible string section for pulling the flexible string section so that the clamp member can slide along the flexible string section to the releasing position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
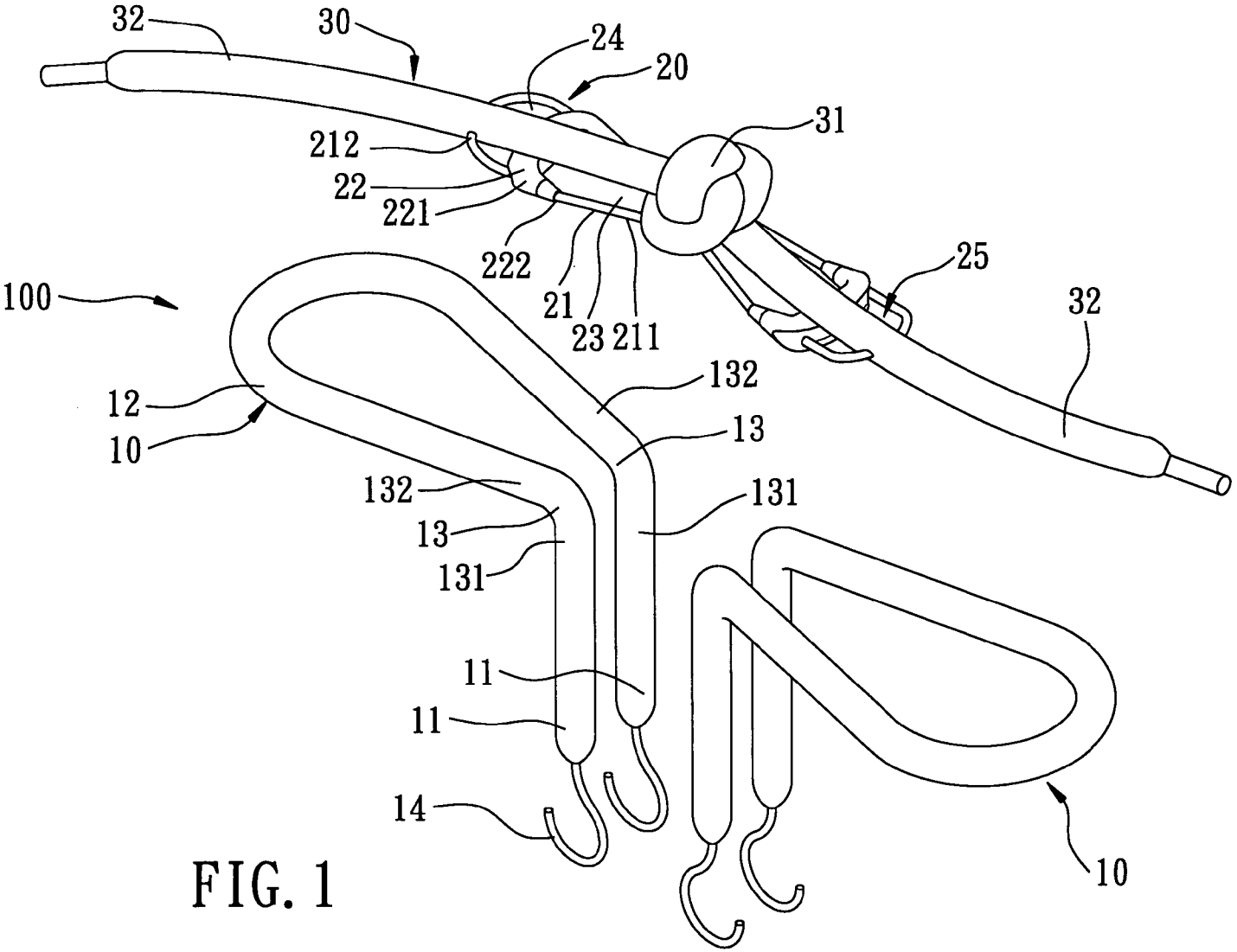
FIG. 1 is an exploded perspective view of the first preferred embodiment of a shoe tightening device according to this invention.
Figure 2:
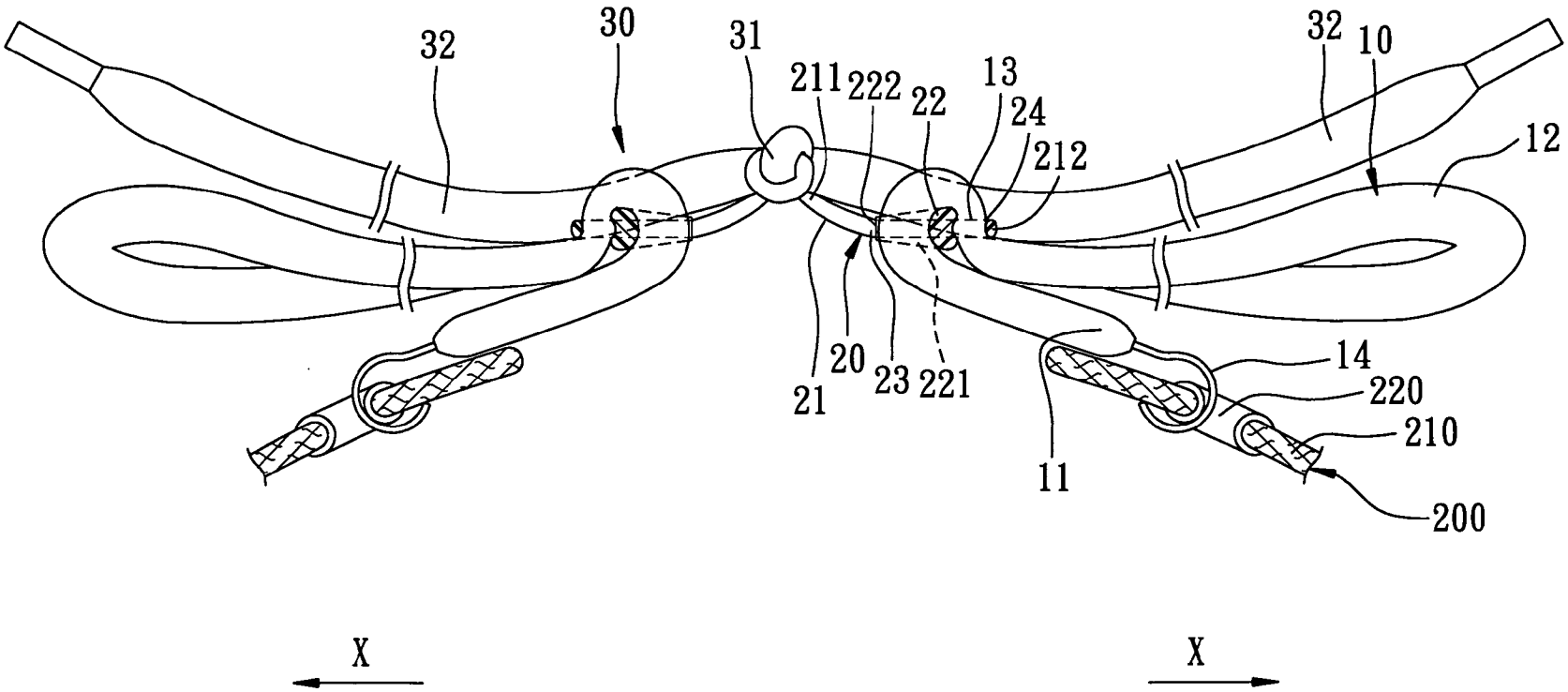
FIG. 2 is a fragmentary sectional view of the first preferred embodiment in a clamping position.
Figure 3:
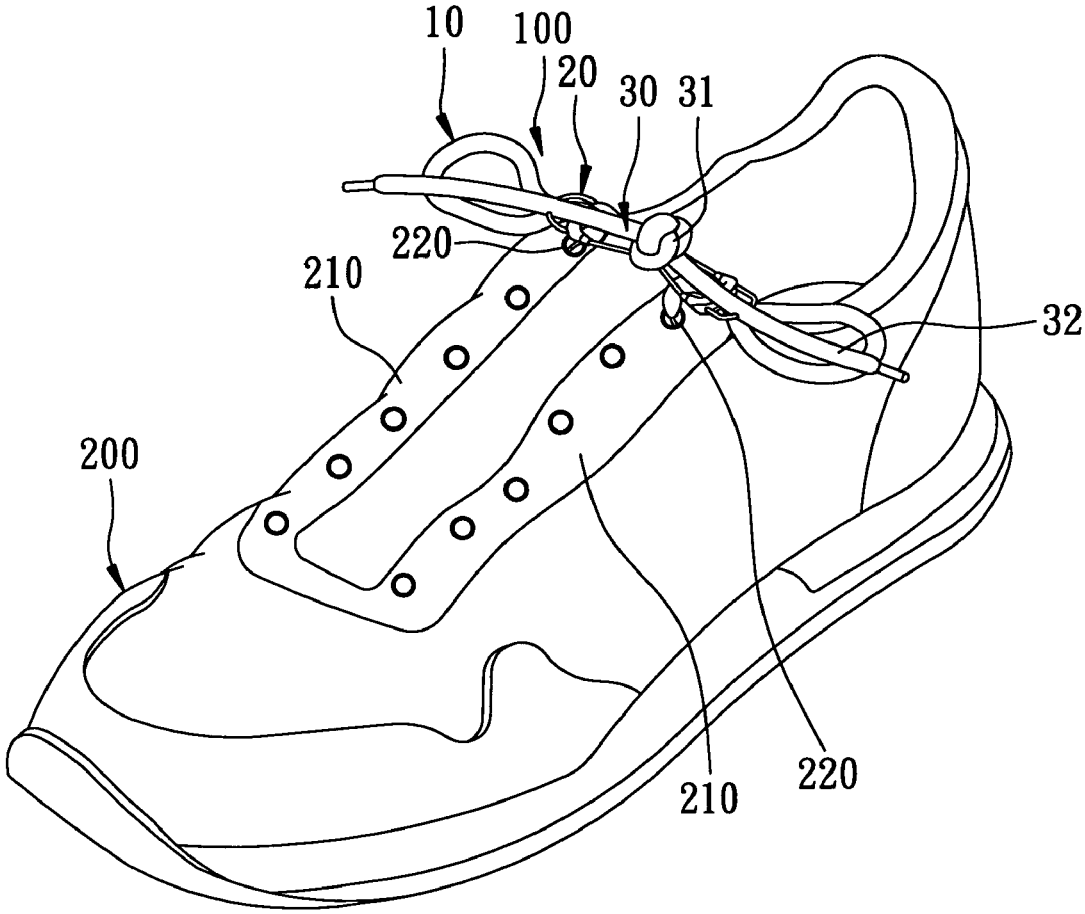
FIG. 3 is a perspective view of the first preferred embodiment of the shoe tightening device when mounted on a shoe.

Referring to FIGS. 1, 2 and 3, the first preferred embodiment of a shoe tightening device 100 according to this invention is shown to be adapted for use with a shoe 200 which includes a pair of eyelet tabs 210, each of which has a plurality of eyelets 220. The shoe tightening device 100 includes a pair of lace units 10, a clamp unit 20, and a pull lace 30. It should be noted herein that, except for FIG. 3, the shoe tightening device 100 is not drawn to scale in the accompanying drawings and is actually illustrated in a magnified form for the sake of clarity.

Each of the lace units 10 includes two connecting end portions 11, two operating end portions 12 opposite to the connecting end portions 11 and integrated with each other to form a U-shaped segment, two intermediate portions 13 interconnecting the connecting end portions 11 and the operating end portions 12 correspondingly, and two anchoring elements 14 mounted on the connecting end portions 11 correspondingly and anchored removably on the eyelet tabs 210 at corresponding ones of the eyelets 220. The intermediate portions 13 of each of the lace units 10 have entry parts 131 proximate to the connecting end portions 11 and exit parts 132 proximate to the operating end portions 12.

Figure 4:
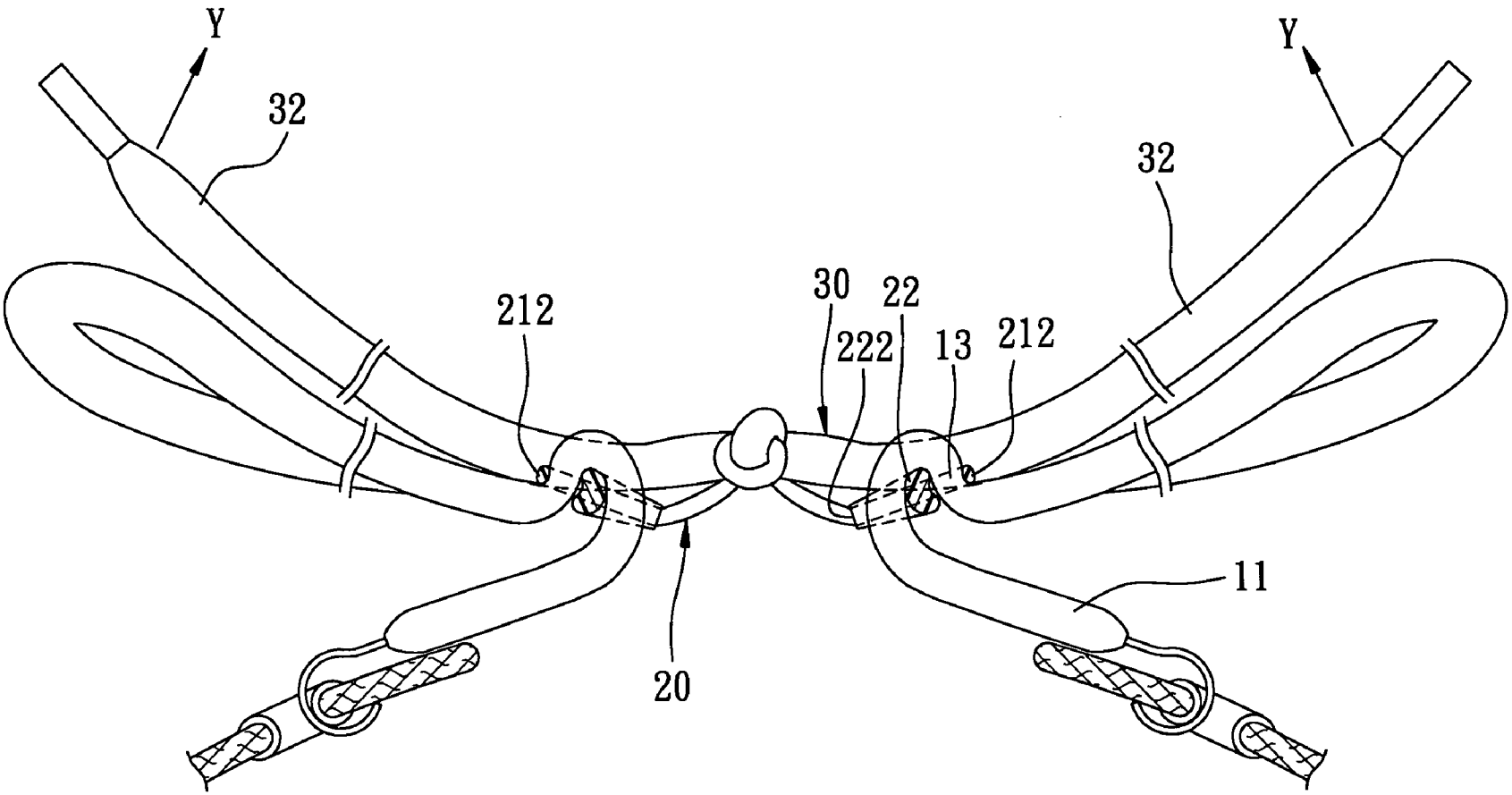
FIG. 4 is a fragmentary sectional view of the first preferred embodiment in a releasing position.

The clamp unit 20 removably clamps the lace units 10, and includes a pair of generally U-shaped flexible string sections 21, each of which defines an opening 25, and a pair of clamp members 22, each of which is attached slidably to and extends across a corresponding one of the flexible string sections 21 to divide the corresponding opening 25 into a first aperture 23 and a second aperture 24. The flexible string sections 21 can be made of transparent nylon material. Each of the clamp members 22 has two opposite ends 221 respectively formed with slots 222. Each of the flexible string sections 21 extends through the slots 222 of the corresponding one of the clamp members 22. Furthermore, each of the flexible string sections 21 has a U-bend 212 which cooperates with the corresponding one of the clamp members 22 to confine the second aperture 24. The first aperture 23 receives the entry parts 131 of the intermediate portions 13 of a corresponding one of the lace units 10. The second aperture 24 receives the exit parts 132 of the intermediate portions 13 of the corresponding one of the lace units 10. Each of the clamp members 22 is slidable along the corresponding one of the flexible string sections 21 between a clamping position in which the clamp member 22 moves toward the U-bend 212 to clamp the exit parts 132 of the intermediate portions 13 of the corresponding one of the lace units 10 against the U-bend 212 for maintaining a tightened state of the shoe 200, as best shown in FIG. 2, and a releasing position in which the clamp member 22 moves away from the U-bend 212 to permit sliding movement of the intermediate portions 13 of the corresponding one of the lace units 10 for loosening the shoe 200 accordingly, as best shown in FIG. 4.

The pull lace 30 is connected to the flexible string sections 21 for pulling the flexible string sections 21 so that each of the clamp members 22 can slide along the corresponding one of the flexible string sections 21 to the releasing position. In this embodiment, the pull lace 30 and the lace units 10 are made of the same material. The pull lace 30 includes an intermediate knot portion 31 and two string segments 32 integrated with and extending outward from the intermediate knot portion 31. Each of the string segments 32 is a single-line string segment. The U-bends 212 of the flexible string sections 21 are attached to the pull lace 30. Specifically, the U-bend 212 of each of the flexible string sections 21 is connected to a corresponding one of the string segments 32 of the pull lace 30. Additionally, each of the flexible string sections 21 has one end 211 remote from the U-bend 212 and connected to the intermediate knot portion 31.

Referring again to FIGS. 2 and 3, after the clamp unit 20 is attached to the pull lace 30, each of the lace units 10 is passed through the first aperture 23 of a corresponding one of the flexible string sections 21, crosses over the clamp member 22 attached to the corresponding one of the flexible string sections 21, and is then passed through the second aperture 24 of the corresponding one of the flexible string sections 21 so that the operating end portions 12 formed integrally as U-shaped segments cooperate with the intermediate knot portion 31 and the string segments 32 of the pull lace 30 to simulate a double-bow configuration.

After the shoe tightening device 100 is mounted on the shoe 200 by anchoring the anchoring elements 14 of the lace units 10 on the corresponding ones of the eyelets 220, a foot (not shown) is slipped into the shoe 200. The operating end portions 12 of the lace units 10 can be pulled apart from each other as indicated by arrows (X) in FIG. 2 to tighten the shoe 200. When the shoe 200 is tightened, the eyelet tabs 210 are forced apart by the foot in the shoe 200, thereby applying tension on the connecting end portions 11 of the lace units 10. At the same time, each of the clamp members 22 is forced by the corresponding connecting end portions 11 to move toward the U-bend 212 of the corresponding one of the flexbile string sections 21 such that the intermediate portions 13 of each of the lace units 10 is clamped in the clamping position between the corresponding one of the clamp members 22 and the corresponding U-bend 212 for maintaining a tightened state of the shoe (see FIG. 2).

Referring to FIG. 4, to loosen the shoe 200, a manual pulling force is applied on the string segments 32 of the pull lace 30, as indicated by arrows (Y) in FIG. 4. This results in movement of each of the clamp members 22 away from the corresponding U-bend 212, thereby releasing the intermediate portions 13 from being clamped by the clamp members 22 against the U-bends 212 so as to loosen the shoe 200 accordingly.

In view of the aforesaid, the shoe tightening device 100 of the present invention is easy to operate. Moreover, since there is no need to string a shoelace through the eyelets 220 of the eyelet tabs 210 as required in the prior art, the shoe tightening device 100 of this invention can be mounted on and removed from the shoe 200 easily, and can tighten and loosen the shoe 200 easily and quickly.

Figure 5:
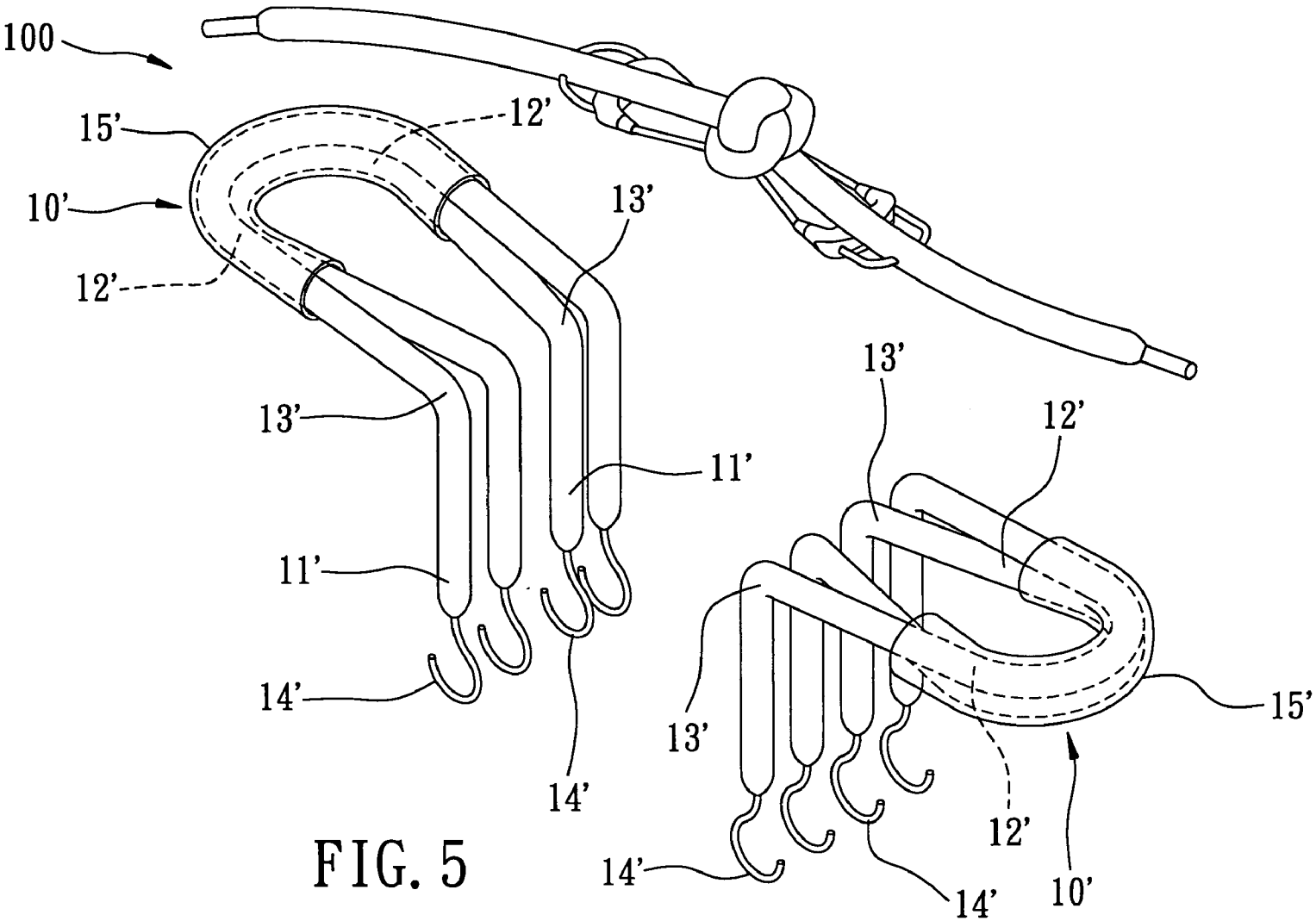
FIG. 5 is an exploded perspective view of the second preferred embodiment of a shoe tightening device according to this invention.
Figure 6:
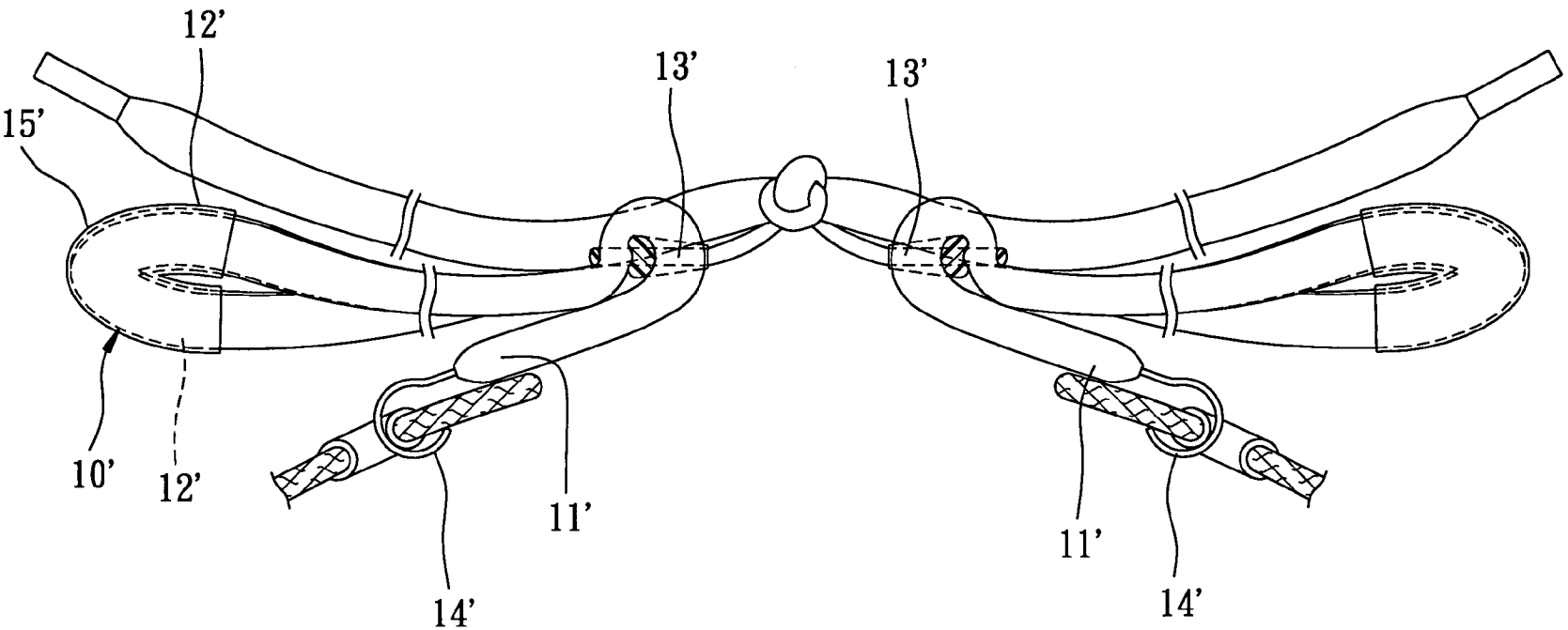
FIG. 6 is a fragmentary sectional view of the second preferred embodiment in a clamping position.

Referring to FIGS. 5 and 6, the second preferred embodiment of the shoe tightening device 100 according to this invention is shown to be similar to the first preferred embodiment, except that the each of the lace units 10' includes four connecting end portions 11', two pairs of operating end portions 12', four intermediate portions 13' interconnecting the connecting end portions 11' and the operating end portions 12' correspondingly, and four anchoring elements 14' mounted on the connecting end portions 11' correspondingly and adapted to be anchored removably on the corresponding ones of the eyelets 220. Each of the pairs of the operating end portions 12' is integrated with each other to form a U-shaped segment. Each of the lace units 10' further includes a U-shaped tubular segment 15' for receiving the operating end portions 12' of the corresponding one of the lace units 10'.

Figure 7:
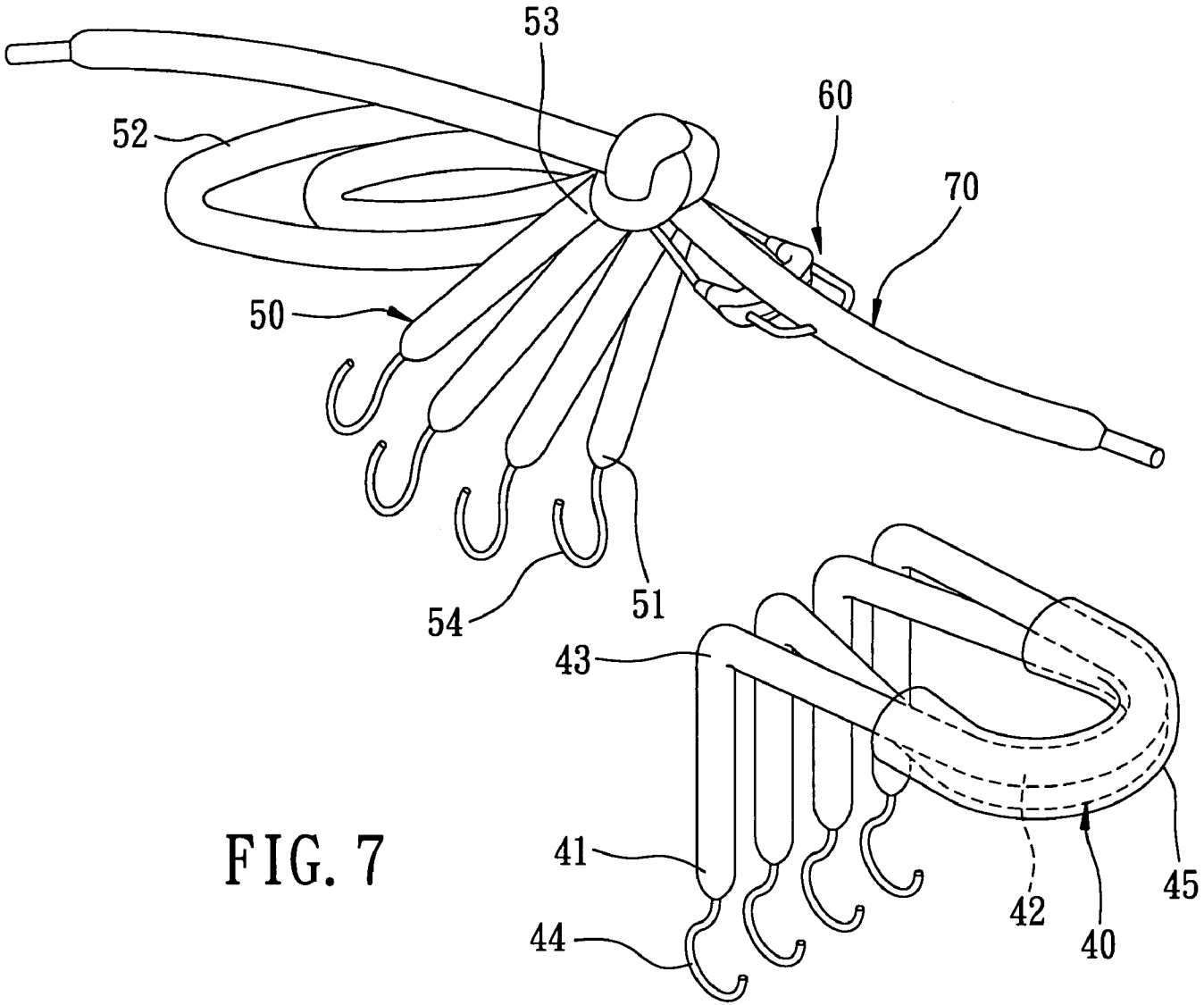
FIG. 7 is an exploded perspective view of the third preferred embodiment of a shoe tightening device according to this invention.
Figure 8:
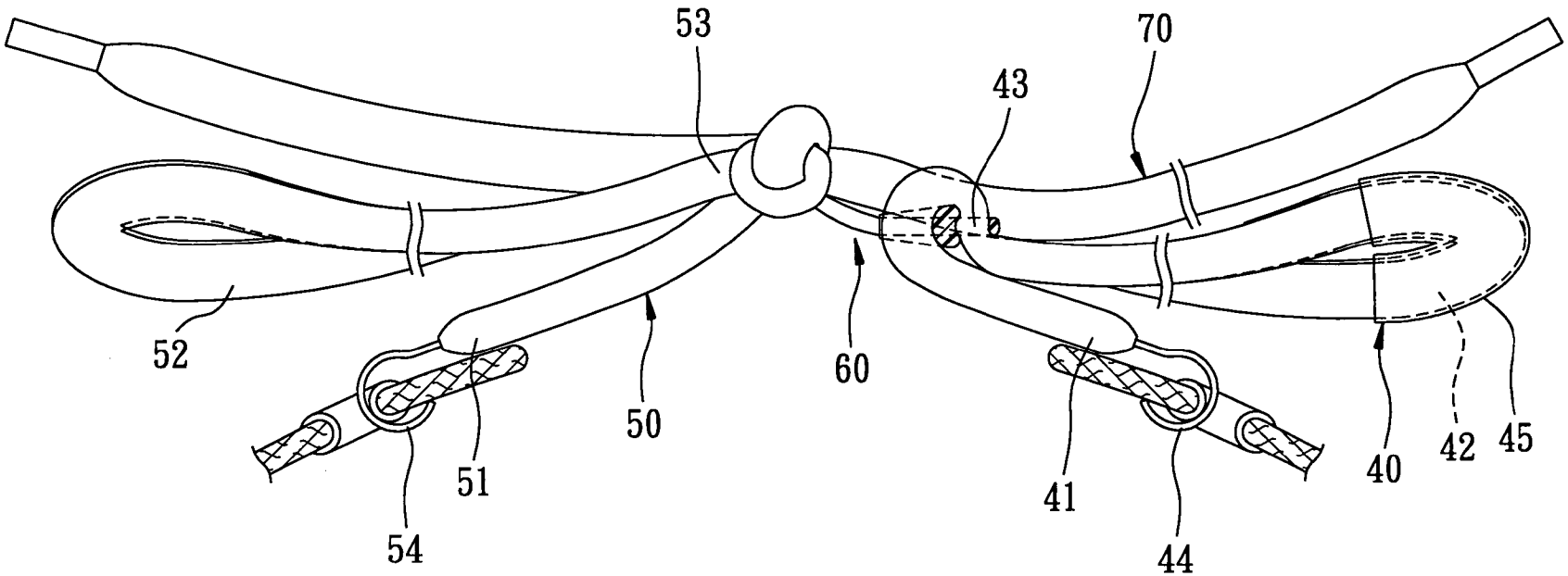
FIG. 8 is a fragmentary sectional view of the third preferred embodiment in a clamping position.

Referring to FIGS. 7 and 8, the third preferred embodiment of the shoe tightening device 100 according to this invention is shown to be similar to the first preferred embodiment, except that the first lace unit 40 that is clamped by the clamp unit 60 includes four connecting end portions 41, two pairs of operating end portions 42, four intermediate portions 43 interconnecting the connecting end portions 41 and the operating end portions 42 correspondingly, and four anchoring elements 44 mounted on the connecting end portions 41 correspondingly and adapted to be anchored removably on corresponding ones of the eyelets 220. Each of the pairs of the operating end portions 42 is integrated with each other to form a U-shaped segment. The first lace unit 40 further includes a U-shaped tubular segment 45 for receiving the operating end portions 42 of the first lace unit 40. The second lace unit 50 includes four connecting end portions 51, two pairs of operating end portions 52, four intermediate portions 53 interconnecting the connecting end portions 51 and the operating end portions 52 correspondingly and fixed on the pull lace 70, and four anchoring elements 54 mounted on the connecting end portions 51 correspondingly and adapted to be anchored removably on corresponding ones of the eyelets 220. Each of the pairs of the operating end portions 52 is integrated with each other to form a U-shaped segment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe tightening device for use with a shoe that includes a pair of eyelet tabs each having a plurality of eyelets, said shoe tightening device comprising:

a pair of lace units, each including a plurality of connecting end portions, a plurality of operating end portions opposite to said connecting end portions, a plurality of intermediate portions interconnecting said connecting end portions and said operating end portions correspondingly, and a plurality of anchoring elements mounted on said connecting end portions correspondingly and adapted to be anchored removably on the eyelet tabs at corresponding ones of the eyelets, said intermediate portions of at least one of said lace units having entry parts proximate to said connecting end portions and exit parts proximate to said operating end portions;

a clamp unit removably clamping at least one of said lace units, and including at least one generally U-shaped flexible string section defining an opening, and at least one clamp member attached slidably to and extending across said flexible string section to divide said opening into a first aperture and a second aperture, said flexible string section having a U-bend which cooperates with said clamp member to confine said second aperture, said first aperture receiving said entry parts of said intermediate portions of a corresponding one of said lace units, said second aperture receiving said exit parts of said intermediate portions of the corresponding one of said lace units, said clamp member being slidable along said flexible string section between a clamping position in which said clamp member moves toward said U-bend to clamp said exit parts of said intermediate portions of the corresponding one of said lace units against said U-bend for maintaining a tightened state of the shoe, and a releasing position in which said clamp member moves away from said U-bend to permit sliding movement of said intermediate portions of the corresponding one of said lace units for loosening the shoe accordingly; and a pull lace connected to said flexible string section for pulling said flexible string section so that said clamp member can slide along said flexible string section to said releasing position.

2. The shoe tightening device as claimed in claim 1, wherein said U-bend of said flexible string section is attached to said pull lace.

3. The shoe tightening device as claimed in claim 1, wherein said clamp member has two opposite ends respectively formed with slots, said flexible string section extending through said slots.

4. The shoe tightening device as claimed in claim 1, wherein said clamp unit includes a pair of said flexible string sections, and a pair of said clamp members respectively attached to said flexible string sections, each of said lace units including two of said connecting end portions, two of said operating end portions integrated with each other to form a U-shaped segment, two of said intermediate portions interconnecting said connecting end portions and said operating end portions correspondingly, and two of said anchoring elements mounted on said connecting end portions correspondingly and adapted to be anchored removably on the corresponding ones of the eyelets.

5. The shoe tightening device as claimed in claim 4, wherein said pull lace and said lace units are made of the same material, said pull lace including an intermediate knot portion and two string segments integrated with and extending outward from said intermediate knot portion, each of said string segments being a single-line string segment.

6. The shoe tightening device as claimed in claim 5, wherein said U-bend of each of said flexible string sections is connected to a corresponding one of said string segments, each of said flexible string sections further having one end remote from said U-bend and connected to said intermediate knot portion.

7. The shoe tightening device as claimed in claim 1, wherein said clamp unit includes a pair of said flexible string sections, and a pair of said clamp members respectively attached to said flexible string sections, each of said lace units including four of said connecting end portions, two pairs of said operating end portions, each of said pairs of said operating end portions being integrated with each other to form a U-shaped segment, four of said intermediate portions interconnecting said connecting end portions and said operating end portions correspondingly, and four of said anchoring elements mounted on said connecting end portions correspondingly and adapted to be anchored removably on the corresponding ones of the eyelets.

8. The shoe tightening device as claimed in claim 7, wherein said pull lace and said lace units are made of the same material, said pull lace including an intermediate knot portion and two string segments integrated with and extending outward from said intermediate knot portion, each of said string segments being a single-line string segment.

9. The shoe tightening device as claimed in claim 8, wherein said U-bend of each of said flexible string sections is connected to a corresponding one of said string segments, each of said flexible string sections further having one end remote from said U-bend and connected to said intermediate knot portion.

10. The shoe tightening device as claimed in claim 8, wherein said each of said lace units further includes a U-shaped tubular segment for receiving said operating end portions of said corresponding one of said lace units.

11. The shoe tightening device as claimed in claim 1, wherein:

one of said lace units that is clamped by said clamp unit includes four of said connecting end portions, two pairs of said operating end portions, each of said pairs of said operating end portions being integrated with each other to form a U-shaped segment, four of said intermediate portions interconnecting said connecting end portions and said operating end portions correspondingly, and four of said anchoring elements mounted on said connecting end portions correspondingly and adapted to be anchored removably on the corresponding ones of the eyelets, the other one of said lace units including four of said connecting end portions, two pairs of said operating end portions, each of said pairs of said operating end portions being integrated with each other to form a U-shaped segment, four of said intermediate portions interconnecting said connecting end portions and said operating end portions correspondingly and fixed on said pull lace, and four of said anchoring elements mounted on said connecting end portions correspondingly and adapted to be anchored removably on the corresponding ones of the eyelets.

12. The shoe tightening device as claimed in claim 11, wherein said one of said lace units that is clamped by said clamp unit further includes a U-shaped tubular segment for receiving said operating end portions of said one of said lace units.

* * * * *